United States Patent [19]

Nakasato et al.

[11] Patent Number: 4,461,495

[45] Date of Patent: Jul. 24, 1984

[54] PRESSURE SENSITIVE COPYING PAPER

[75] Inventors: Yukiya Nakasato, Matsudo; Atsuo Kuramoto, Tokyo; Sadao Morishita, Ibaraki; Shigetoshi Hiraishi, Tokyo, all of Japan

[73] Assignees: Mitsubishi Paper Mills, Ltd.; Mitsubishi Gas Chemcail, Co., Inc., both of Tokyo, Japan

[21] Appl. No.: 396,372

[22] Filed: Jul. 8, 1982

[30] Foreign Application Priority Data

Jul. 9, 1981 [JP] Japan ..... 56-107385

[51] Int. Cl.[3] ..... B41M 5/16

[52] U.S. Cl. ..... 346/211; 346/212; 346/216; 346/225

[58] Field of Search ..... 282/27.5; 427/150, 151; 428/320.4–320.8, 452, 454, 913, 914, 411, 537

[56] References Cited

U.S. PATENT DOCUMENTS

| | | | |
|---|---|---|---|
| 4,226,962 | 10/1980 | Stolfo | 282/27.5 |
| 4,262,936 | 4/1981 | Miyamoto | 282/27.5 |
| 4,263,047 | 4/1981 | Miyamoto et al. | 282/27.5 |

FOREIGN PATENT DOCUMENTS

| | | | |
|---|---|---|---|
| 48-8216 | 3/1973 | Japan | 346/225 |
| 54-40898 | 3/1979 | Japan | 346/225 |

*Primary Examiner*—Bruce H. Hess

*Attorney, Agent, or Firm*—Cushman, Darby & Cushman

[57] ABSTRACT

A condensate free from stickiness and exhibiting an excellent initial color-formability when used as color developer of pressure sensitive copying paper can be obtained by reacting p-hydroxybenzoic acid and one p-alkyl-substituted phenol or a mixture of two or more p-alkyl-substituted phenols with formaldehyde in the presence of an acid catalyst and then directly taking out the condensate into cold water without any procedure such as dehydration, concentration, etc.

12 Claims, No Drawings

PRESSURE SENSITIVE COPYING PAPER

This invention relates to a pressure sensitive copying paper in which a novel color-developing agent is used.

There have hitherto been known various forms of pressure sensitive copying papers, where there is generally utilized the formation of colored substance by reaction between a leuco dye which is an electron-donating substance (hereinafter, referred to as "color former") and an electron-accepting substance (hereinafter, referred to as "color developer"). One unit of this type of pressure sensitive copying paper is constituted of an over sheet (coated back sheet) prepared by dissolving a color former into a nonvolatile solvent to obtain a color former solution, making the solution into microcapsule and coating backside of a support with the microcapsule and an under sheet (coated front sheet) prepared by coating front side of another support with color developer. If such over sheet and under sheet are superposed so that their coated surfaces confront each other and then a pressure is applied to them, the capsule coated on the backside of over sheet is ruptured to allow exudation of the solution of color former, which comes into contact with the color developer coated on under sheet to produce a color.

As the color developer for use in pressure sensitive copying papers, there are hitherto known clays such as acid clay, bentonite, kaolinite and the like, substituted phenol-formaldehyde resin, salicylic acid derivatives, their metallic salts, and so on. However, none of them has fully satisfactory properties necessary for use in pressure sensitive copying paper. For example, clays adsorb the gases and water present in the air to cause yellowing of paper surface and deterioration in color-forming performances. Substituted phenol-formaldehyde resin has a tendency of allowing the yellowing of coated surface during storage and upon irradiation with sunlight, and it is poor in color-developing performances to Benzoyl Leucomethylene Blue (hereinafter, simply referred to as "BLMB") which is a light-resistant color former. Metallic salts of salicylic acid derivatives are poor in oil-solubility and stability to hydrolysis, and they have a tendency of forming a color when wet with water. As a color developer which has overcome these faults, salicylic acid-p-alkyl-substituted phenol resin has recently been disclosed in Japanese Patent Publication No. 8,216/73 and Japanese Patent Kokai (Laid-Open) No. 40,898/79. This color developer is excellent in color-developing performances and clarity of formed image, and it is soluble in most organic solvents.

However, this type of resin is inferior in initial color density and is quite difficult to pulverize finely due to its stickiness. Accordingly, in applying this resin as a color developer to base paper, it is usual to prepare a coating color by dissolving it into an organic solvent and mixing the solution with a large amount of pigment and a binder. Such a procedure, however, has a problem in point of environmental security and from the viewpoint of production process.

Based on the above-mentioned knowledges, the present inventors conducted a study with the aim of overcoming the faults in the hitherto known color developer. As the result, it was found that a condensate free from stickiness and initial color-formability when used as a color developer can be obtained by reacting p-hydroxybenzoic acid and one p-alkyl-substituted phenol or a mixture of two or more p-alkyl-substituted phenols with formaldehyde in the presence of an acid catalyst and then directly taking out the condensate into cold water without any procedure such as dehydration, concentration or the like. Since this condensate had a lubricating character, it could easily be pulverized finely by means of a wet type pulverizing machine. It was also found that, by mixing or reacting the pulverized condensate with a compound of polyvalent metal, there was obtained a product markedly improved in color-forming performances and light-resistance and sharpness of colored image and improved in resistance to light-yellowing when coated on paper and resistance to yellowing due to nitrogen oxide. It was also found that, by mixing a clay into the above-mentioned condensate or a product obtained by mixing or reacting the condensate with a compound of polyvalent metal, the printability was improved and the color-formability was markedly improved.

As the p-alkyl-substituted phenols which can be used in this invention, those having $C_1$–$C_{12}$ substituent such as p-cresol, p-ethylphenol, p-isopropylphenol, p-tert-butylphenol, p-tert-amylphenol and p-tert-octylphenol, and preferably those having $C_4$–$C_{12}$ substituent, can be referred to. The objective condensate can be obtained by reacting one of the above-mentioned p-alkyl-substituted phenols or a mixture of two or more of them with p-hydroxybenzoic acid. Said p-alkyl-substituted phenols and said p-hydroxybenzoic acid may have other substituents so far as the object of this invention can be achieved.

The molar ratio between the p-hydroxybenzoic acid and the p-alkyl-substituted phenol used in this invention (p-hydroxybenzoic acid/p-alkyl-substituted phenol) is in the range of 0.1–5 and preferably in the range of 0.5–3, more preferably in the range of 0.5–2.

As the formaldehyde source used in this invention, all the substances generating formaldehyde under the reaction conditions, such as formaldehyde, paraformaldehyde and the like, can be used. As the catalyst, phosphoric acid, hydrochloric acid, oxalic acid, p-toluenesulfonic acid, sulfuric acid and the like can be used.

In this invention, the molar ratio of formaldehyde to [p-alkyl-substituted phenol+p-hydroxybenzoic acid] is usually 0.4–1 and preferably 0.6–0.8.

As examples of said polyvalent metal compound, oxides, hydroxides, carbonates, basic carbonates, phosphates, silicates and sulfates of zinc, aluminum, titanium, nickel, cobalt, magnesium and calcium can be referred to. As the metal in said polyvalent metal compound, zinc is particularly preferable. As the compound of the metal, oxide, hydroxide and basic carbonate are preferable, among which oxide is particularly preferable. Though the ratio of polyvalent metal compound to condensate is usually selected from the range of 1:99 to 99:1 (by weight) appropriately, a ratio falling in the range of 5:95 to 80:20 is preferable if flatness of the copying paper obtained and economicity are taken into consideration. In reacting the polyvalent metal compound, the reaction temperature is in the range not lower than room temperature and not higher than 240° C., and preferably 80°–180° C. When a clay such as acid clay, kaolinite or the like is used, the ratio of said clay to condensate may be appropriately selected from the range of 1:99 to 99:1 (by weight). If flatness of copying paper obtained and economicity are taken into consideration, however, the ratio is preferably in the range of 5:95 to 80:20.

In this invention, the color developer is produced in the form of an aqueous coating color containing the above-mentioned condensate. It is usually produced by mixing an aqueous emulsion obtained by treating a finely pulverized product of the condensate in the presence of a dispersion stabilizer by means of sand grinding mill, colloid mill, attritor or the like with various additives for additionally improving various properties of pressure sensitive copying paper such as pigment other than polyvalent metal compound and clay, pigment dispersant, binder and so on. When a polyvalent metal and a clay are to be mixed therein, they may be mixed in the step of preparing the aqueous emulsion or into the already prepared aqueous emulsion.

As examples of said pigment other than polyvalent metal compound, inorganic pigments such as synthetic silica, glass powder and the like, organic pigments such as urea-formaldehyde resin, styrene and the like, and so on can be referred to.

Said polyvalent metal compound, said clay and said pigment other than polyvalent metal compound and clay may be used either alone or in combination.

As said pigment dispersant, there can be used dispersants of nonionic, cationic and anionic types, and the like. As said binder, there can be used modified starches such as oxidized starch, enzyme starch, alkylated starch and the like; water-soluble proteins such as casein, gelatin and the like; synthetic rubber latices such as styrene-butadiene latex (SBR), methyl methacrylate-butadiene latex (MBR), and the like; and water-soluble polymers such as polyvinyl alcohol (PVA), carboxymethyl-cellulose (CMC), hydroxyethylcellulose and the like. As other additives, fluorescent whitening agent, antioxidant, antifoaming agent and the like can be used. By applying such an aqueous coating color to a paper, the desired pressure sensitive copying paper can be obtained.

As the support for forming a color developing layer on itself, paper is used mainly. However, various unwoven cloths, plastic films, synthetic papers, metallic foils and the like, as well as composite sheets prepared by combining them, can also be used effectively.

As examples of the color former used in this invention for forming color image by the reaction with color developer, colorless dyes such as crystal violet lactone (hereinafter, simply referred to as CVL), BLMB, rhodamine lactam type of colorless dyes, fluoran type of colorless dyes, spiropyran type of colorless dyes and the like can be referred to.

The specified condensate of this invention has a merit that it has no stickiness, it can easily be pulverized finely by means of wet pulverizing machine.

Furthermore, when a mixture or a reaction product of the condensate and a polyvalent metal salt, or a combination of such a mixture or reaction product with a clay is used, the printability, color-forming performances, light resistance of color image and sharpness of color image can be improved.

Next, examples and comparative examples will be mentioned in order to illustrate this invention more concretely and in more detail. In the examples mentioned below, "parts" and "%" are all by weight. The test of pressure sensitive copying paper was carried out in the following manner.

(1) An over sheet used in test was an over sheet of commercial pressure sensitive copying paper "Over-40, Mitsubishi NCR Paper".

(2) In the color-forming test, an under sheet and the over sheet was superposed and passed through a calender under a pressure of 10 kg/cm$^2$ to form a color, after which the following values were measured.

o Color density

Twenty minutes and 24 hours after passage through calender, color density of formed image was evaluated by measuring the density of blue color by means of densitometer.

o Image density remaining rate after fading (%) =

$$\frac{\text{Density of formed image after fading}}{\text{Density of formed image before fading}} \times 100$$

Twenty four hours after passage through calender, the density of image was evaluated by measuring blue color density by means of densitometer. Then, this color sample was exposed to xenon light for 3 hours in fade-o-meter, after which the density after fading was similarly measured. A greater value of image density remaining rate means that the color image is more resistant to fading.

o Yellowing of under sheet by nitrogen oxide

An under sheet was left standing for +minutes in a vessel containing 150 ppm of nitrogen oxide, after which density of yellow color was measured by means of densitometer. A greater value means a greater extent of yellowing.

o Image density remaining rate after contact with plasticizer (%) =

$$\frac{\text{Density after contact with plasticizer}}{\text{Density before contact with plasticizer}} \times 100$$

Twenty four hours after passage through calender, the under sheet was placed in a polyvinyl chloride bag (0.2 mm in thickness) and left standing overnight at 60° C. to contact the sheet with the plasticizer contained in the polyvinyl chloride, after which density of blue color was measured by means of densitometer.

COMPARATIVE EXAMPLE 1

In a reaction vessel, 69 parts of p-hydroxybenzoic acid, 138 parts of p-tert-octylphenol, 61.5 parts of 37% formalin, 1 part of p-toluenesulfonic acid and 53 parts of water were reacted under reflux for 3 hours, after which the condensate was taken out and solidified. After adding a water containing a dispersant to the condensate, the condensate was pulverized by means of ball mill to obtain an emulsion having an average particle diameter of 2$\mu$. Using the resin emulsion, an aqueous coating color was prepared, from which a pressure sensitive copying paper was prepared.

To 300 parts of an aqueous solution containing 0.5 part of sodium pyrophosphate were added 40 parts of urea-formaldehyde resin as a pigment together with 30 parts of 10% aqueous solution of PVA and 15 parts of SBR latex, to which was added 30 parts of the above-mentioned resin emulsion of which concentration had been adjusted to 40%. After thoroughly stirring the mixture, its pH was adjusted to 9.0 with 20% aqueous solution of sodium hydroxide to obtain a coating color. The coating color was coated on a plain paper having a basis weight of 40 g/m$^2$ by means of Meyer bar so that the coating weight reached 4.5 g/m$^2$ (solid). Thus, an under sheet was prepared. Using this sheet, the color density of image formed thereon, the image density remaining rate after fading, the yellowing by nitrogen oxide and the image density remaining rate after contact with plasticizer were measured. The results are shown in Tables 1, 2, 3 and 4.

EXAMPLE 1

In a reaction vessel, 69 parts of p-hydroxybenzoic acid, 138 parts of p-tert-octylphenol, 61.5 parts of 37% formalin, 1 part of p-toluenesulfonic acid and 53 parts of water were reacted under reflux for 3 hours, after which 21 parts of transparent zinc white was added and the whole mixture was reacted for an additional one hour under reflux. Then, the condensate was taken out and solidified. By adding a water containing an anionic dispersant to the condensate and pulverizing the mixture by means of ball mill, a resin emulsion having an average particle diameter of 2μ was obtained. Using this resin emulsion, the following coating color was prepared, from which a pressure sensitive copying paper was prepared.

Thus, 100 parts of urea-formaldehyde resin was slowly added with stirring to 670 parts of an aqueous solution containing 0.5 part of sodium pyrophosphate and thoroughly dispersed. Then, 100 parts of 10% aqueous solution of PVA and 40 parts of SBR latex were added and then 30 parts of the above-mentioned 40% resin emulsion was added. After thoroughly stirring the mixture, its pH was adjusted to 9.0 with 20% aqueous solution of sodium hydroxide to obtain a coating color. The coating color was coated on a plain paper having a basis weight of 40 g/m$^2$ by means of Meyer bar so that the coating weight reached 9.1 g/m$^2$ (solid) to obtain an under sheet. It was tested in the same manner as in Comparative Example 1. The results are shown in Tables 1–4.

EXAMPLE 2

To 100 parts of an aqueous solution containing 0.5 part of sodium pyrophosphate were slowly added 80 parts of aluminum hydroxide and 20 parts of zinc oxide with stirring. After thoroughly dispersing them, 100 parts of 10% aqueous solution of PVA and 10 parts of SBR latex were added and then 30 parts of the 40% resin emulsion obtained in Comparative Example 1 was added. After thoroughly stirring the mixture, its pH was adjusted to 9.0 with 20% sodium hydroxide solution to obtain a coating color. This coating color was coated on a plain quality paper having a basis weight of 40 g/m$^2$ by means of Meyer bar so that the coating weight reached 9.1 g/m$^2$ (solid) to obtain an under sheet. Using the under sheet, color density of image formed thereon, image density remaining rate after fading, yellowing by nitrogen oxide and image density remaining rate after contact with plasticizer were measured. The results are shown in Tables 1, 2, 3 and 4.

COMPARATIVE EXAMPLE 2

To 100 parts of an aqueous solution containing 0.5 part of sodium pyrophosphate were slowly added 30 parts of activated clay and 70 parts of kaolinite with stirring. After sufficiently dispersing them, 100 parts of 10% aqueous solution of PVA and 10 parts of SBR latex were added and then 30 parts of the 40% resin emulsion obtained in Comparative Example 1 was added. After thoroughly stirring the mixture, its pH was adjusted to 9.0 with 20% sodium hydroxide solution to obtain a coating color. This coating color was coated on a plain paper having a basis weight of 40 g/m$^2$ by means of Meyer bar so that the coating weight reached 9.1 g/m$^2$ (solid). Using the under sheet thus prepared, color density of image formed thereon, image density remaining rate after fading, yellowing by nitrogen oxide and image density remaining rate after contact with plasticizer were measured. The results are shown in Tables 1, 2, 3 and 4.

EXAMPLE 3

To 100 parts of an aqueous solution containing 0.5 part of sodium pyrophosphate were slowly added 55 parts of aluminum hydroxide, 35 parts of kaolinite and 10 parts of zinc oxide with stirring. After sufficiently dispersing them, 100 parts of 10% aqueous solution of PVA and 10 parts of SBR latex were added and then 30 parts of the 40% resin emulsion obtained in Example 2 was added. After thoroughly stirring the mixture, its pH was adjusted to 9.0 with 20% sodium hydroxide solution to obtain a coating color. This coating color was coated on a plain paper having a basis weight of 40 g/m$^2$ by means of Meyer bar so that the coating weight reached 5.4 g/m$^2$ (solid) to prepare an under sheet. Using this under sheet, color density of image formed thereon, image density remaining rate after fading, yellowing by nitrogen oxide and image density remaining rate after contact with plasticizer were measured. The results are shown in Tables 1, 2, 3 and 4.

COMPARATIVE EXAMPLE 3

In a reaction vessel, 69 parts of salicylic acid, 138 parts of p-tert-octylphenol, 61.5 parts of 37% formalin, 1 part of p-toluenesulfonic acid and 53 parts of water were reacted under reflux for 3 hours, after which the condensate was taken out and solidified. According to the procedure mentioned in Comparative Example 1, it was made into an aqueous coating color, from which a pressure sensitive copying paper was prepared. Properties of the pressure sensitive copying paper were measured to obtain the results shown in Tables 1, 2, 3 and 4.

COMPARATIVE EXAMPLE 4

In a reaction vessel, 100 parts of p-hydroxybenzoic acid, 39 parts of 37% formalin, 1 part of p-toluenesulfonic acid and 38 parts of water were reacted under reflux for 3 hours, after which the condensate was taken out and solidified. The resin (condensate) had a stickiness, so that it could not be pulverized by means of wet type pulverizing machine such as ball mill. Therefore, pressure sensitive copying paper could not be prepared therefrom.

TABLE 1

| | Color density 20 minutes after color formation | Color density 24 hours after color formation |
|---|---|---|
| Comparative Example 1 | 0.47 | 0.52 |
| Comparative Example 3 | 0.40 | 0.43 |
| Comparative Example 4 | — | — |
| Example 1 | 0.50 | 0.55 |
| Example 2 | 0.49 | 0.55 |
| Comparative Example 2 | 0.51 | 0.60 |
| Example 3 | 0.59 | 0.70 |

TABLE 2

| | Image density remaining rate after fading (%) |
|---|---|
| Comparative Example 1 | 38.5 |
| Comparative Example 3 | 37.2 |
| Comparative Example 4 | — |
| Example 1 | 75.0 |
| Example 2 | 74.5 |
| Comparative Example 2 | 76.7 |
| Example 3 | 77.0 |

TABLE 3

| | Image density remaining rate after contact with plasticizer (%) |
|---|---|
| Comparative Example 1 | 21.3 |
| Comparative Example 3 | 20.5 |
| Comparative Example 4 | — |
| Example 1 | 90.0 |
| Example 2 | 92.0 |
| Comparative Example 2 | 77.5 |
| Example 3 | 92.8 |

TABLE 4

| | Yellowing by nitrogen oxide |
|---|---|
| Comparative Example 1 | 0.20 |
| Comparative Example 3 | 0.21 |
| Comparative Example 4 | — |
| Example 1 | 0.14 |
| Example 2 | 0.14 |
| Comparative Example 2 | 0.15 |
| Example 3 | 0.14 |

What is claimed is:

1. A pressure sensitive copying paper wherein a layer of a color developer capable of reacting with a color former to form a color image is coated on a support, characterized in that said color developer comprises a mixture or reaction product of a polyvalent metal compound and a condensate obtained by reacting p-hydroxybenzoic acid and a p-alkylphenol having a $C_1$–$C_{12}$ alkyl group with formaldehyde in the presence of an acid catalyst.

2. A pressure sensitive copying paper according to claim 1, wherein the color developer includes a clay.

3. A pressure sensitive copying paper according to claim 1, wherein the alkyl substituent in said p-alkyl phenol has 4–12 carbon atoms.

4. A pressure sensitive copying paper according to claim 1, wherein said p-alkyl phenol is p-tert-octylphenol or p-tert-butylphenol.

5. A pressure sensitive copying paper according to claim 4 wherein said p-alkylphenol is p-tert-octylphenol.

6. A pressure sensitive copying paper according to claim 4 wherein said p-alkylphenol is p-tert-butylphenol.

7. A pressure sensitive copying paper according to claim 1, wherein the molar ratio of p-hydroxybenzoic acid to p-alkyl-substituted phenol is 0.1–5.

8. A pressure sensitive copying paper according to claim 7 wherein the molar ratio of p-hydroxybenzoic acid to p-alkyl-substituted phenol is 0.5–3.

9. A pressure sensitive copying paper according to claim 8 wherein said ratio is 0.5–2.

10. A pressure sensitive copying paper according to claim 1, wherein the molar ratio formaldehyde/is 0.4–1.

11. A pressure sensitive copying paper according to claim 10 wherein said ratio is 0.6–0.8.

12. A pressure sensitive copying paper according to claim 1, wherein the polyvalent metal constituting said polyvalent metal compound to be reacted with said condensate is selected from the group consisting of zinc, aluminum, titanium, nickel, cobalt, magnesium and calcium and said polyvalent metal compound is selected from the group consisting of oxides, hydroxides, carbonates, basic carbonates, phosphates, silicates and sulfates of the above-mentioned polyvalent metals.

* * * * *